US011749143B2

(12) United States Patent
Moradi et al.

(10) Patent No.: US 11,749,143 B2
(45) Date of Patent: Sep. 5, 2023

(54) PIXEL CIRCUIT, DISPLAY, AND METHOD

(71) Applicant: Ignis Innovation Inc., Waterloo (CA)

(72) Inventors: Arash Moradi, Toronto (CA); Jafar Talebzadeh, Waterloo (CA); Junhu He, Waterloo (CA); Shuenn-Jiun Tang, Guelph (CA)

(73) Assignee: Ignis Innovation Inc., Road Town (VG)

( * ) Notice: Subject to any disclaimer, the term of this patent is extended or adjusted under 35 U.S.C. 154(b) by 414 days.

(21) Appl. No.: 16/198,840

(22) Filed: Nov. 22, 2018

(65) Prior Publication Data

US 2019/0156718 A1 May 23, 2019

Related U.S. Application Data

(60) Provisional application No. 62/590,075, filed on Nov. 22, 2017.

(51) Int. Cl.

| | |
|---|---|
| ***G09G 3/00*** | (2006.01) |
| ***G09G 3/3225*** | (2016.01) |
| ***G09G 3/3233*** | (2016.01) |
| ***G09G 3/3291*** | (2016.01) |

(52) U.S. Cl.

CPC ..... *G09G 3/006* (2013.01); *G09G 3/3225* (2013.01); *G09G 3/3233* (2013.01); *G09G 3/3291* (2013.01); *G09G 2300/0819* (2013.01); *G09G 2300/0842* (2013.01); *G09G 2310/0251* (2013.01); *G09G 2320/0295* (2013.01); *G09G 2320/043* (2013.01); *G09G 2320/045* (2013.01); *G09G 2330/12* (2013.01)

(58) Field of Classification Search

CPC .... G09G 3/006; G09G 3/3233; G09G 3/3291; G09G 2300/0819; G09G 2300/0842; G09G 2310/0251; G09G 2310/0264; G09G 2320/0295; G09G 2320/043; G09G 2320/045; G09G 2330/12

USPC ..... 345/204

See application file for complete search history.

(56) References Cited

U.S. PATENT DOCUMENTS

| | | | | |
|---|---|---|---|---|
| 2014/0035799 | A1* | 2/2014 | Bae | G09G 3/3266 345/82 |
| 2015/0379940 | A1* | 12/2015 | Kishi | G09G 3/3291 345/690 |
| 2016/0055791 | A1* | 2/2016 | Kishi | G09G 3/3241 345/212 |

(Continued)

OTHER PUBLICATIONS

Microsoft Computer Dictionary, 474 (5th ed. 2002).*
McGraw-Hill Dictionary of Scientific and Technical Terms, 1706 (4th ed. 1989).*

*Primary Examiner* — Roberto W Flores
*Assistant Examiner* — Aaron Midkiff
(74) *Attorney, Agent, or Firm* — Stratford Group Ltd.

(57) ABSTRACT

Active Matrix Organic Light Emitting Diode (AMOLED) displays, novel pixel circuits therefor, and methods of programming the pixel circuit and measuring the current of the pixel circuit and OLED thereof are disclosed. One pixel circuit includes four TFT transistors, a storage capacitor and an OLED device and is programmed with use of voltage supplied through a data line. One method measures currents of the OLED and the pixel circuit through the data line by a readout circuit.

22 Claims, 14 Drawing Sheets

(56) References Cited

U.S. PATENT DOCUMENTS

| | | | | |
|---|---|---|---|---|
| 2016/0140902 | A1* | 5/2016 | Yang | G09G 3/3258 345/78 |
| 2016/0148566 | A1* | 5/2016 | Tseng | G09G 3/3233 345/212 |
| 2016/0163261 | A1* | 6/2016 | Kim | G09G 3/3233 345/205 |

* cited by examiner

PIXEL CIRCUIT, DISPLAY, AND METHOD

CROSS-REFERENCE TO RELATED APPLICATION

This application claims the benefit of U.S. Provisional Application No. 62/590,075, filed Nov. 22, 2017, which is hereby incorporated by reference herein in its entirety.

FIELD OF THE PRESENT DISCLOSURE

The present disclosure relates to active matrix organic light emitting diode (AMOLED) displays and particularly to pixel circuits thereof and methods of driving and measuring pixel and organic light emitting diode (OLED) currents in order to extract pixel and OLED parameters.

BRIEF SUMMARY

According to a first aspect there is provided a display system comprising: an array of pixel circuits arranged in rows and columns, a pixel circuit of the array of pixel circuits including: a drive transistor including a source terminal coupleable to a data line of the display system; a storage capacitor coupled across a gate terminal and a source terminal of the drive transistor; and a light emitting device coupleable to the source terminal of the drive transistor, and a controller for driving the pixel circuit in a plurality of operation states for the pixel circuit including a programming state for programming the storage capacitor of the pixel circuit with use of a data voltage provided over the data line, and a measurement state for measuring a current from the pixel circuit over the data line.

Some embodiments further provide for a readout circuit coupleable to the data line for measuring the current from the pixel circuit over the data line.

In some embodiments, the readout circuit comprises an integrator for integrating said current from the pixel during said measuring and generating an output voltage corresponding to said integrated current, and an analog to digital converter for converting said output voltage into a digital code output.

In some embodiments, the readout circuit is not coupleable to the pixel circuit via a signal line different from the data line for measuring the current from the pixel circuit.

In some embodiments, the measurement state for measuring a current from the pixel circuit comprises an organic light emitting diode (OLED) measurement state for measuring an OLED current from the pixel circuit passing through said light emitting device.

In some embodiments, the pixel circuit further comprises a reference line coupleable to a gate terminal of the drive transistor, and in which the controller, during the OLED measurement state, couples the gate terminal of the drive transistor to the reference line and provides a reference voltage over the reference line sufficient to completely turn off the drive transistor, couples the light emitting device to the data line and provides a data voltage over the data line sufficient to turn on the light emitting device.

In some embodiments, the display system further comprises a readout circuit coupleable to the data line for measuring the current from the pixel circuit over the data line, the readout circuit comprising an integrator for integrating said OLED current from the pixel during said measuring and generating a corresponding output voltage, and an analog to digital converter for converting said output voltage into a digital code output, in which the controller couples the gate terminal of the drive transistor to the reference line with use of a first transistor in the pixel circuit, and couples the light emitting device to the data line with use of a second transistor coupled between the source terminal of the drive transistor and the data line and a third transistor coupled between the light emitting device and the source terminal of the drive transistor.

In some embodiments, the measurement state for measuring a current from the pixel circuit comprises a pixel circuit measurement state for measuring a pixel circuit current from the pixel circuit passing through said drive transistor, said pixel circuit measurement state subsequent to the programming state.

In some embodiments, the controller, during the pixel circuit measurement state, decouples the light emitting device from the source terminal of the drive transistor with use of a first transistor coupled between the source terminal of the drive transistor and the light emitting device and couples the source terminal of the drive transistor to the data line.

In some embodiments the display system further comprises a readout circuit coupleable to the data line for measuring the current from the pixel circuit over the data line, the readout circuit comprising an integrator for integrating said pixel circuit current from the pixel circuit during said measuring and generating a corresponding output voltage and an analog to digital converter for converting said output voltage into a digital code output, in which the pixel circuit further comprises a reference line coupleable to a gate terminal of the drive transistor, in which the controller decouples the reference line from the gate terminal of the drive transistor to maintain a voltage difference across the storage capacitor, and in which the controller couples the source terminal of the drive transistor to the data line with use of a second transistor coupled between the source terminal of the drive transistor and the data line.

In some embodiments, the pixel circuit comprises transistors which are only n-type thin film transistors (TFTs), and in which said light emitting device is an OLED.

According to another aspect there is provided a method of driving a display system, the display system including an array of pixel circuits arranged in rows and columns, a pixel circuit of the array of pixel circuits including: a drive transistor including a source terminal coupleable to a data line of the display system; a storage capacitor coupled across a gate terminal and a source terminal of the drive transistor; and a light emitting device coupleable to the source terminal of the drive transistor, the method comprising: driving the pixel circuit in a plurality of operation states for the pixel circuit including: programming the storage capacitor of the pixel circuit with use of a data voltage provided over the data line during a programming state, and measuring a current from the pixel circuit over the data line during a measurement state.

In some embodiments, measuring the current from the pixel circuit comprises coupling a readout circuit to the data line and measuring said current from the pixel circuit with use of said readout circuit.

In some embodiments, measuring said current from the pixel circuit with use of said readout circuit comprises integrating said current from the pixel circuit, generating a corresponding output voltage, and converting said output voltage into a digital code output.

In some embodiments, measuring the current from the pixel circuit comprises measuring an OLED current from the pixel circuit passing through said light emitting device during an OLED measurement state.

In some embodiments, the pixel circuit further comprises a reference line coupleable to a gate terminal of the drive transistor, and in which measuring the OLED current during the OLED measurement state comprises, coupling the gate terminal of the drive transistor to the reference line, providing a reference voltage over the reference line sufficient to completely turn off the drive transistor, coupling the light emitting device to the data line, and providing a data voltage over the data line sufficient to turn on the light emitting device.

In some embodiments, measuring the OLED current during the OLED measurement state comprises: coupling the gate terminal of the drive transistor to the reference line with use of a first transistor in the pixel circuit; coupling the light emitting device to the data line with use of a second transistor coupled between the source terminal of the drive transistor and the data line and a third transistor coupled between the light emitting device and the source terminal of the drive transistor; and coupling a readout circuit to the data line and measuring said current from the pixel circuit with use of said readout circuit, including, integrating said OLED current from the pixel circuit, generating an output voltage corresponding to the integrated current, and converting said output voltage into a digital code output.

In some embodiments, measuring said current from the pixel circuit comprises measuring a pixel circuit current from the pixel circuit passing through said drive transistor, during a pixel circuit measurement state subsequent to the programming state.

In some embodiments, measuring the pixel current during the pixel circuit measurement state comprises decoupling the light emitting device from the source terminal of the drive transistor with use of a first transistor coupled between the gate terminal of the drive transistor and the light emitting device and coupling the source terminal of the drive transistor to the data line.

In some embodiments, measuring the pixel circuit current during the pixel circuit measurement state comprises: decoupling a reference line from the gate terminal of the drive transistor to maintain a voltage difference across the storage capacitor; coupling the source terminal of the drive transistor to the data line with use of a second transistor coupled between the source terminal of the drive transistor and the data line; and coupling a readout circuit to the data line and measuring said current from the pixel circuit with use of said readout circuit, including, integrating said pixel circuit current from the pixel circuit, generating an output voltage corresponding to the integrated current, and converting said output voltage into a digital code output.

The foregoing and additional aspects and embodiments of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the disclosure will become apparent upon reading the following detailed description and upon reference to the drawings.

Figure 1:
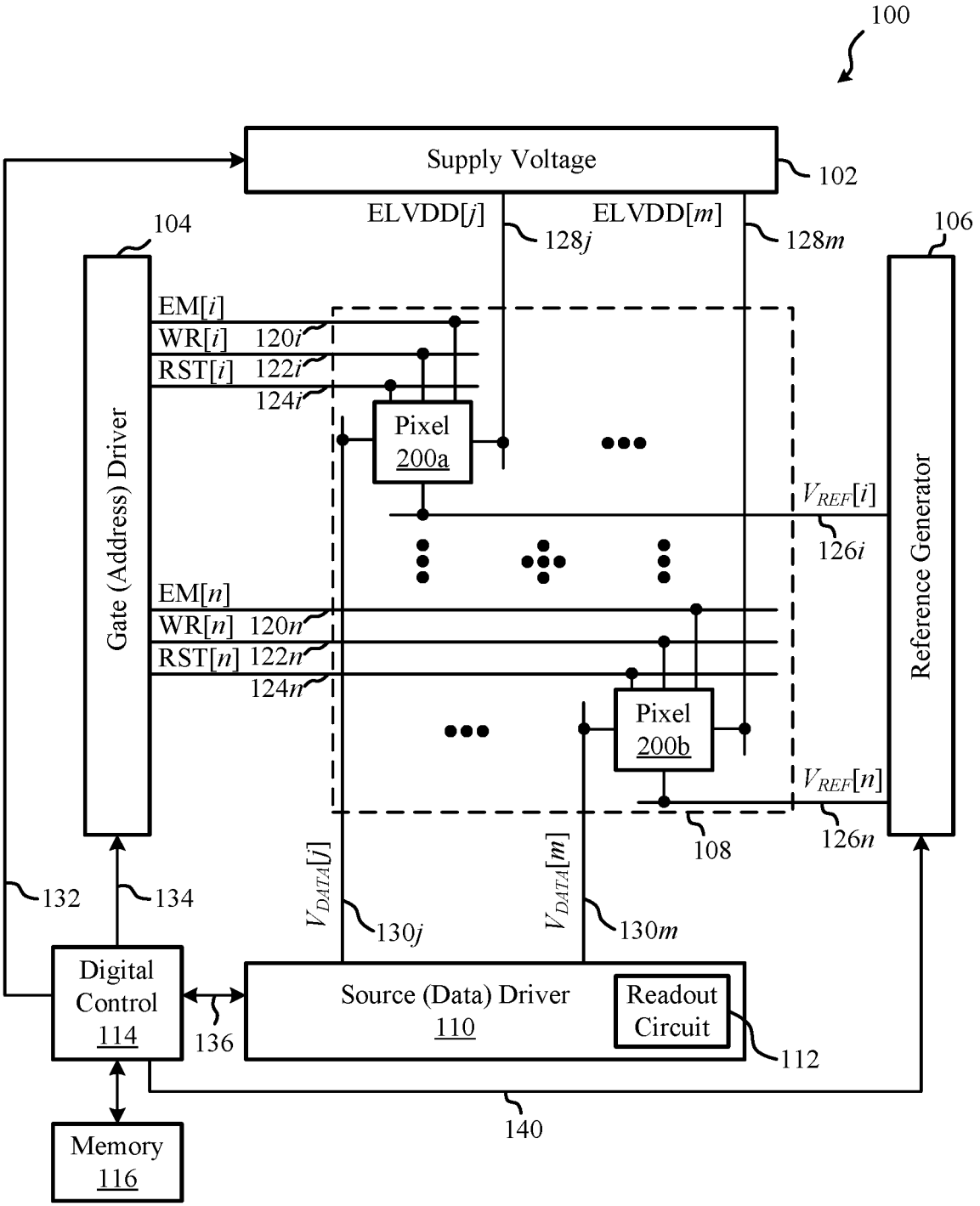
FIG. 1 is a schematic block diagram of an example active matrix display system in accordance with an embodiment.

While the present disclosure is susceptible to various modifications and alternative forms, specific embodiments or implementations have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of an invention as defined by the appended claims.

DETAILED DESCRIPTION

An OLED device is a Light Emitting Diode (LED) in which the emissive electroluminescent layer is a film of organic compound that emits light in response to an electric current. This layer of organic material is situated between two electrodes; typically, at least one of these electrodes is transparent. Compared to conventional Liquid Crystal Displays (LCDs), Active Matrix Organic Light Emitting Device (AMOLED) displays offer lower power consumption, manufacturing flexibility, faster response time, larger viewing angles, higher contrast, lighter weight, and amenability to flexible substrates. An AMOLED display works without a backlight because the organic material of the OLED within each pixel itself emits visible light and each pixel consists of different colored OLEDs emitting light independently. The OLED panel can display deep black level and can be thinner than an LCD display. The OLEDs emit light according to currents passing through them supplied through drive transistors controlled by programming voltages. The power consumed in each pixel has a relation with the magnitude of the generated light in that pixel.

The quality of output in an OLED-based pixel depends on the properties of the drive transistor, which is typically fabricated from materials including but not limited to amorphous silicon, polysilicon, or metal oxide, as well as properties of the OLED itself. In particular, the critical drawbacks of OLED displays include luminance non-uniformity due to the electrical characteristic variations of the drive transistor such as threshold voltage and mobility as the pixel ages and image sticking due to the differential aging of OLED devices. In order to maintain high image quality, variation of these parameters must be compensated for by adjusting the programming voltage. In order to do so, those parameters are extracted from the driver circuit. The measured information can then be used to inform subsequent programming of the pixel circuits so that adjustments may be made to the programming taking into account the measured degradation.

Aspects of the present disclosure include a novel pixel circuit in display panels and methods to drive and measure the pixel and OLED current in order to extract parameters of the pixel. The pixel circuit includes a Light-Emitting Device (LED), such as an Organic Light Emitting Diode (OLED), a storage capacitor and Thin Film Transistors (TFTs). Some methods include supplying voltage or current to the pixel circuit from the source via the data line and measuring an electric current in the data line. Some methods further include converting the measured current to voltage for further processing. For example, a source driver having a ReadOut Circuit (ROC) may be utilized for measuring a current from the pixel circuit. In some embodiments, the current from the pixel circuit can be either the current of the driving TFT or the current of the OLED. The current is converted into a corresponding voltage and then an Analog-to-Digital Convertor (ADC) is used to convert the voltage to a digital code, i.e. a 10 to 16 bit digital code. The digital code is provided to a digital processor for further processing.

Figure 2:
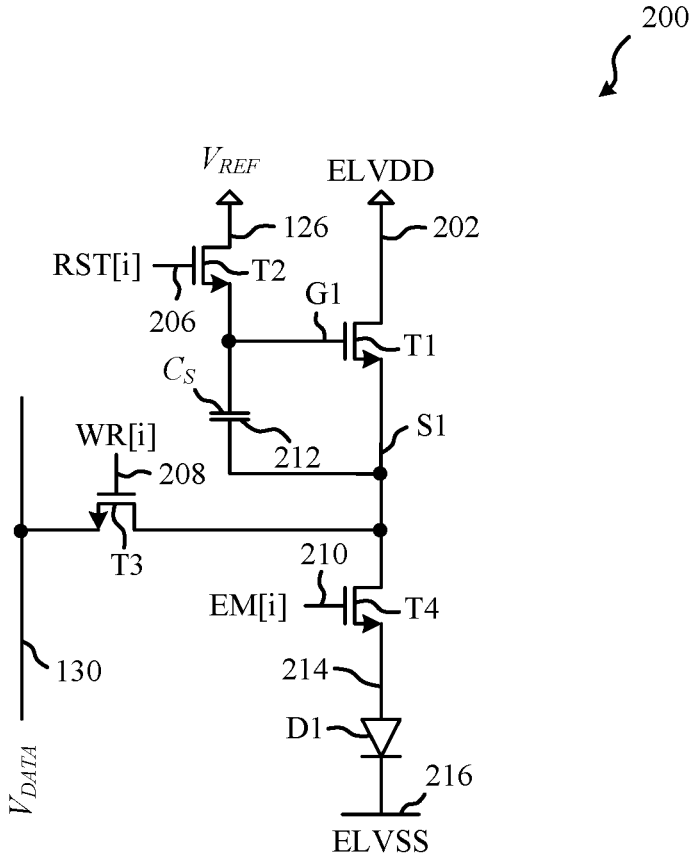
FIG. 2 is a schematic circuit diagram of an embodiment of a pixel circuit for the display of FIG. 1, the pixel circuit including four TFT transistors, an OLED, and a capacitor.

FIG. 1 is a block diagram of an exemplary OLED display system 100 according to an embodiment. The display system 100 includes a display panel 108, a source driver 110 which includes a Readout Circuit (ROC) 112, a gate driver 104, a controller 114, a memory storage 116, a reference generator 106, and a supply voltage block 102. The display panel 108 includes a plurality of pixels 200 arranged in "n" rows and "m" columns. Each pixel 200 has a pixel circuit including four Thin Film Transistors (TFTs), a storage capacitor and an OLED as shown in FIG. 2. Each pixel 200 is individually programmed to emit light with specific luminance values. The digital controller 114 receives digital video data indicative of information to be displayed on the display panel 108. The controller 114 sends signals 136 comprising digital video data to the source driver 110 and signals 134 to the gate (address) driver 104 to drive the pixels 200 in the display panel 108 in row by row basis to display the information indicated. The plurality of pixels 200 associated with the display panel 108 thus comprise a display array ("display screen") adapted to dynamically display information according to the input digital data received by the controller 114. The display screen 108 can display, for example, video information from a stream of video data (not shown) received by the controller 114. The supply voltage block 102 provides a constant or an adjustable supply for the display panel 108 which is controlled by the signals 132 from the controller 114. The reference generator block 106 provides constant or adjustable reference voltages for the display panel 108 which is controlled by the signals 140 from the controller 114.

FIG. 1 is illustrated with only two pixels 200*a* and 200*b* in the display panel 108 for sake of simplicity and illustrative purposes. The display system 100 can be implemented with a plurality of similar pixels, such as the pixel 200 and the display panel size is not restricted to a particular number of rows and columns of pixels. For example, the display system 100 can be implemented with a display panel with a number of rows and columns of pixels commonly available in displays for mobile devices, monitor-based devices, TVs, and projection devices.

According to an embodiment, an exemplary pixel circuit 200 of a display system of FIG. 1, is shown in FIG. 2, the pixel circuit comprising four n-type TFTs (T1, T2, T3 and T4), a storage capacitor ($C_s$) 212, an OLED device D1, and input with three control signals. A drive transistor T1 is coupled in series with the OLED device D1, and the storage capacitor ($C_s$) 212 is coupled across a source and a gate of the drive transistor T1. Transistor T4, controlled by EM[i] 210, is coupled between the source of the drive transistor T1 and the OLED device D1, transistor T3, controlled by WR[i] 208, is coupled between the source of the drive transistor T1 and the data line 130, while transistor T2, controlled by RST[i] 206, is coupled between the gate of the drive transistor T1 and the reference line 126. Control signals EM[i] 210, WR[i] 208 and RST[i] 206 are control signals of the ith row, and are the emission, write, and reset signal respectively for the pixel circuit 200. All the control signals are provided by the gate driver block 104, as controlled by the controller 114, as shown in FIG. 1. The reference voltage $V_{REF}$ is common for all pixels located in each row. These reference voltages $V_{REF}$ [i] and $V_{REF}$ [n] are provided over reference lines 126*i* and 126*n* by the reference voltage generator 106. The pixel circuit 200 includes a storage capacitor $C_s$ 212, for storing the data voltage $V_{DATA}$ provided by the source driver 110 over the data line 130 and for allowing the pixel circuit 200 to drive the OLED device D1 after being addressed. As such, the display panel 108 including a pixel circuit 200, is an active matrix display array. The present disclosure includes a novel pixel circuit in display panels which includes the n-type TFT transistors because the n-type TFT transistors have far less threshold voltage variation than their p-type TFT transistors. Therefore, time for the In-Pixel Compensation (IPC) state (referred to below) can be reduced and even can be removed in order to reduce the total time for the driving mode and pixel measurement mode described below. Although, the transistors utilized in the pixel circuit 200 are n-type Thin Film Transistors (TFTs), implementations of the present disclosure are not limited to pixel circuits having a particular polarity of transistor or only to pixel circuits having thin-film transistors.

FIG. 1 is illustrated with only two pixels 200*a* and 200*b* in the display panel 108. As shown in FIG. 1, the pixel 200*a* illustrated as the top-left pixel in the display panel 108 represents a "ith" row and "jth" column, is coupled to an emission signal line 120*i* for an emission signal EM[i], a write signal line 122*i* for a write signal WR[i], a reset signal line 124*i* for a reset signal RST[i], a supply line 128*j* for a supply voltage ELVDD[ ], a data line 130*j* for a data voltage $V_{DATA}$ [j], and a reference line 126*i* for a reference voltage $V_{REF}$ [i].

As shown in FIG. 1, the pixel 200*b* illustrated as the bottom-right pixel 200 in the display panel 108 represents a "nth" row and "mth" column, is coupled to an emission signal line 120*n* for an emission signal EM[n], a write signal line 122*n* for a write signal WR[n], a reset signal line 124*n* for a reset signal RST[n], a supply line 128*m* for a supply voltage ELVDD[m], a data line 130*m* for a data voltage $V_{DATA}$ [m], and a reference line 126*n* for a reference voltage $V_{REF}$ [n].

As shown in FIG. 1, the gate driver 104 provides the EM, WR, and RST signals for the emission signal lines 120*i*, 120*n*, the write signal lines 122*i*, 122*n*, and the reset signal lines 124*i*, 124*n*. These signals are utilized to control the pixels 200 in the display panel 108 in order to program the pixels 200 or to measure the pixel or OLED currents through the use of the data lines (130*j*, 130*m*). The data line 130 conveys programming information such as a programming voltage or a programming current to the pixel 200 from the source driver 110 to the pixel 200 in order to program the pixel 200 to emit a desired amount of luminance according to the digital data received by the controller 114. The programming voltage or current can be applied to the pixel 200 during a programming operation of the pixel 200 so as to charge a storage device within the pixel 200, such as a storage capacitor, thereby enabling the pixel 200 to emit light with the desired amount of luminance during an emission operation following the programming operation. For example, the storage device in the pixel 200 can be charged during a programming operation to keep the data voltage and then apply it to one or more of a gate or a source terminal of the driving transistor during the emission operation, thereby causing the driving transistor to convey the driving current through the OLED according to the voltage stored on the storage device.

Generally, in the pixel 200, the driving current that is conveyed through the light emitting device by the driving transistor during the emission operation of the pixel 200 is a current that is supplied by the supply line (e.g. the supply line 128*j* and 128*m*). The supply line 128 can provide a positive supply voltage 202 (e.g., the voltage commonly referred to in circuit design as "ELVDD"). In some implementations, a negative or zero (0V) supply voltage ELVSS 216 can be provided over a second supply line to the pixel 200. For example, each pixel can be coupled to a first supply line 128 and a second supply line (not shown) coupled to ELVSS, and the pixel circuits 200 can be situated between the first and second supply lines to facilitate driving current between the two supply lines during emission or other states of the pixel circuit.

In some embodiments, the display system 100 also includes a Readout Circuit (ROC) 112 which is integrated with the source driver 110. The data line (130*j*, 130*m*) connects the pixel 200 to the readout circuit 112. The data line (130*j*, 130*m*) allows the readout circuit 112 to measure a current associated with the pixel 200 and thereby extract information indicative of a degradation of the pixel 200. The Readout circuit 112 converts the associated current into a corresponding voltage. In some embodiments, this voltage is converted into a 10 to 16 bit digital code and is sent to the digital control 114 for further processing or compensation.

In some embodiments, there are three modes of operations for the display system including a drive mode, a pixel measurement mode, and an OLED measurement mode.

Drive Mode

Figure 3:
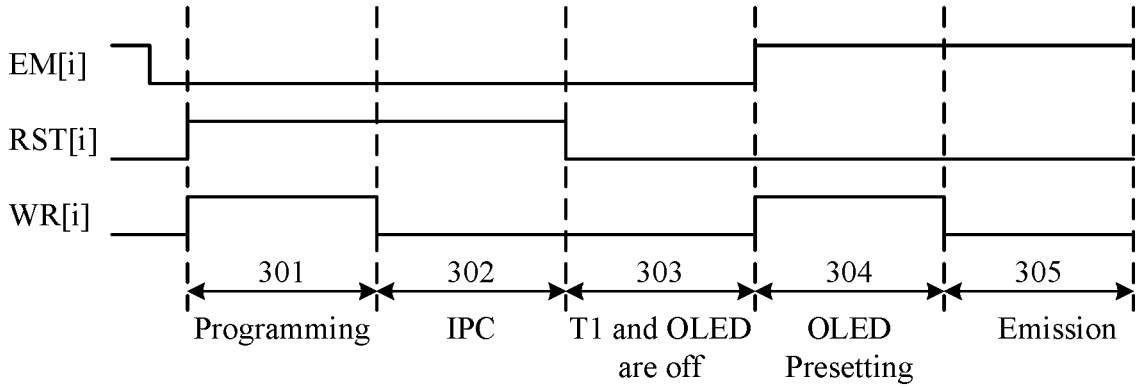
FIG. 3 is an example timing diagram of control signals of the pixel circuit in a drive mode.

A timing diagram for the control signals of the pixel circuit 200 in the drive mode is shown in FIG. 3. The timing diagram shown in FIG. 3 comprises five states which include, programming the pixel during a programming state 301, an In-Pixel Compensation (IPC) state 302, an off state 303, an OLED presetting state 304, and an emission state 305 during which the pixel emits light. During the programming state 301, the storage capacitor $C_s$ 212 is first charged to $V_{REF}-V_{DATA}$, which is the difference between the voltage of the reference line 126 and the voltage of the data line 130. During the In-Pixel Compensation (IPC) state 302, the voltage stored on the capacitor ($C_s$) 212 changes by $\Delta V_{IPC}$. During the off state 303, the T1 transistor and the OLED device D1 are turned off. During the OLED presetting state 304, the OLED device D1 is present. During the emission state 305, the drive transistor T1 drives the OLED device D1 with a current corresponding to the stored data voltage causing it to emit light.

Figure 6:
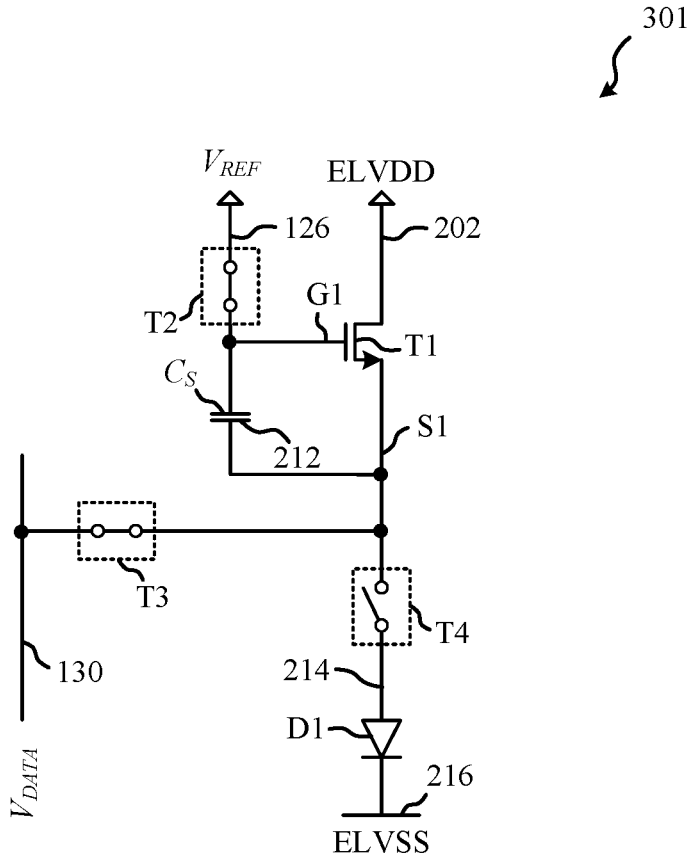
FIG. 6 is a schematic block diagram of the pixel circuit in a programming state of the drive mode.

During the programming state 301 as shown in FIG. 6, the emission signal EM[i]210 is set to zero, i.e. EM[i]=0. This turns off the transistor T4. The write signal WR[i] 208 and the reset signal RST[i] 206 are set to VDD, i.e. WR[i]=VDD and RST[i]=VDD. These signals turn on the transistors T3 and T2 and connect the node G1 (common with the gate of the drive transistor T1) to $V_{REF}$ and the node S1 (common with the source of the drive transistor T1) to $V_{DATA}$. The storage capacitor $C_s$ 212 is charged to $V_{REF}-V_{DATA}$ which is the difference between the voltage on the reference line 126 and the voltage on the data line 130. At the end of the programming state 301, the voltage stored in the storage capacitor $C_s$ 212 is equal to:

$$V_{C_s}=V_{REF}-V_{DATA} \tag{1}$$

Figure 7:
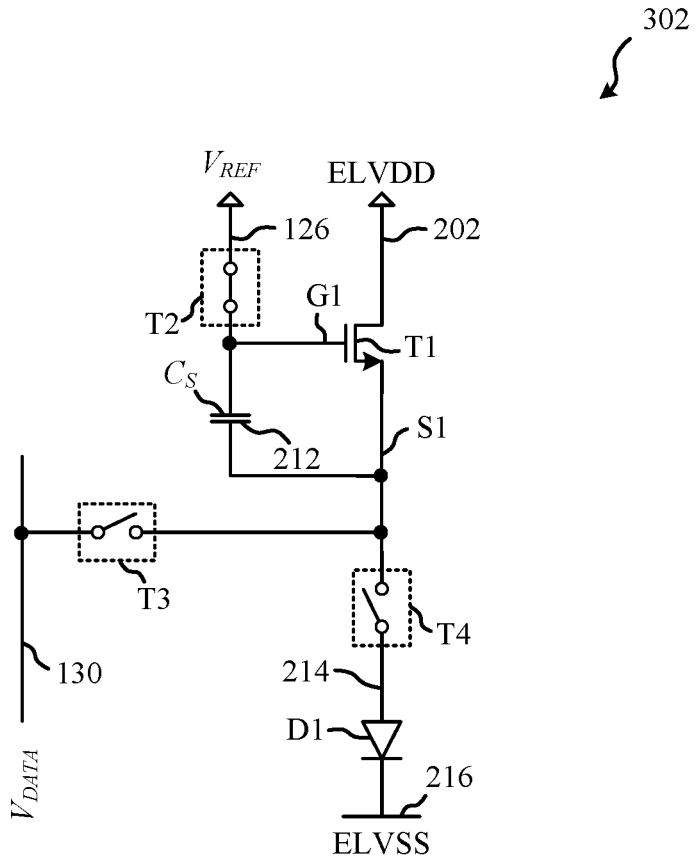
FIG. 7 is a schematic block diagram of the pixel circuit in an In-Pixel Compensation (IPC) state of the drive mode.

During the In-Pixel Compensation (IPC) state 302 as shown in FIG. 7, the emission signal EM[i] 210 and the write signal WR[i] 208 are set to zero, i.e. EM[i]=0 and WR[i]=0. These signals turn off the transistors T4 and T3. The node S1 is disconnected from the data line 130. The reset signal RST[i] signal 206 is set to VDD, i.e. RST[i]=VDD. This turns on the transistor T2. The drive transistor T1 is turned on and IPC is performed in this state. At the end of this state, the voltage stored in the storage capacitor $C_s$ 212 is equal to:

$$V_{C_s}=V_{REF}-V_{DATA}-\Delta V_{IPC} \tag{2}$$

where $\Delta V_{IPC}$ is the voltage drop during this state.

Figure 8:
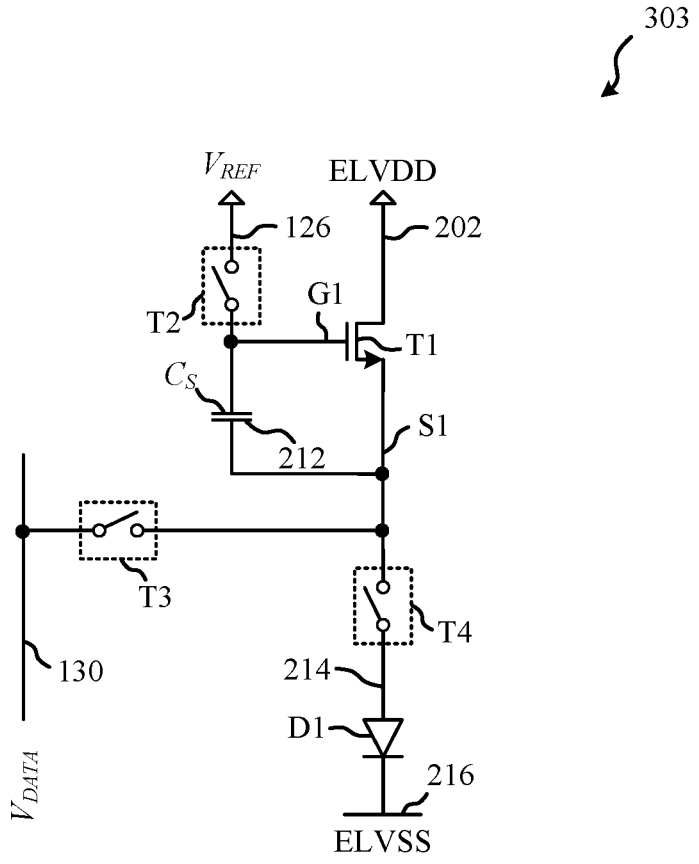
FIG. 8 is a schematic block diagram of the pixel circuit in an off state of the drive mode.

During the off state 303 as shown in FIG. 8, the emission signal EM[i] 210, the write signal WR[i] 208, and the reset signal RST[i] 206 are set to zero, i.e. EM[i]=0, WR[i]=0 and RST[i]=0. These signals turn off the transistors T4, T3 and T2 and disconnect the node S1 from the data line 130 and the node G1 from the reference line 126. During the off state 303, no current is passing through the OLED device D1 and both the drive transistor T1 and the OLED device D1 are off during this state.

Figure 9:
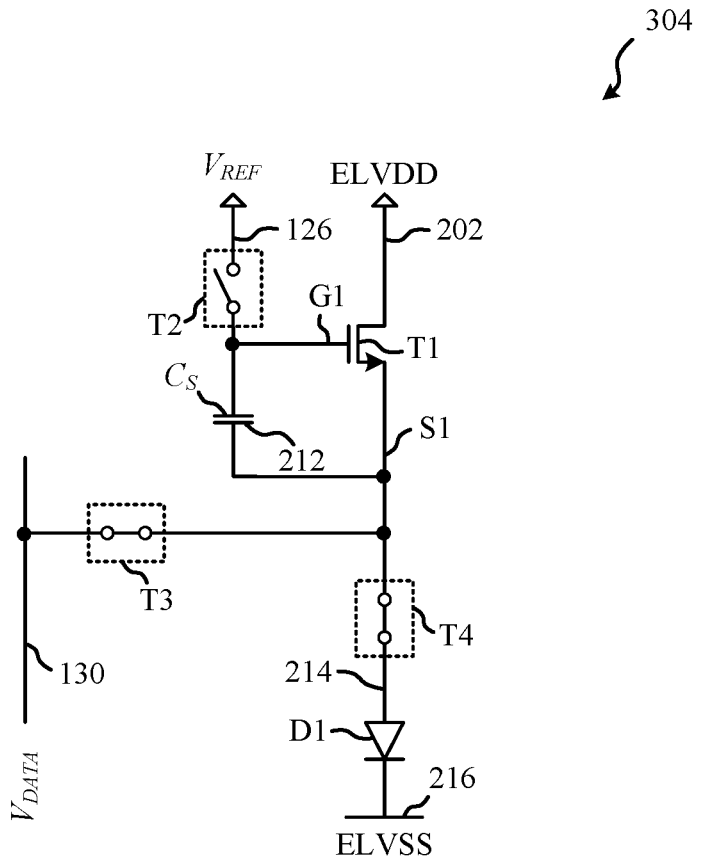
FIG. 9 is a schematic block diagram of the pixel circuit in an OLED presetting state of the drive mode.

During the OLED presetting state 304 as shown in FIG. 9, the emission signal EM[i] 210 and the write signal WR[i] 208 are set to VDD, i.e. EM[i]=VDD and WR[i]=VDD. These signals turn on the transistors T4 and T3. The reset signal RST[i] 206 remains at 0 i.e. RST[i]=0, keeping the transistor T2 off. The anode 214 of the OLED device D1 is connected to the data line 130 through transistors T3 and T4 and it is preset to the voltage $V_{DATA}$ which is already set on the data line 130.

Figure 10:
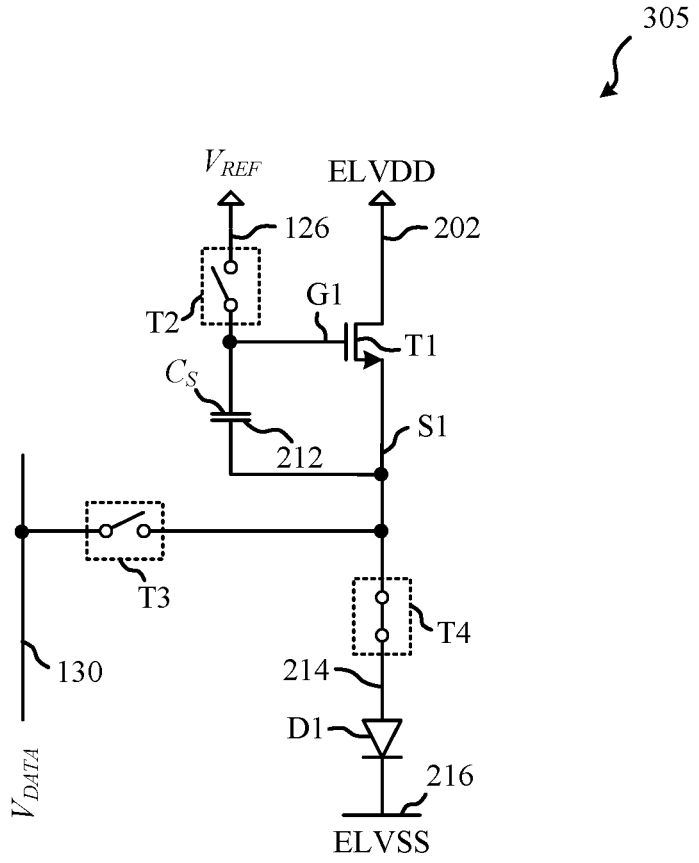
FIG. 10 is a schematic block diagram of the pixel circuit in an emission state of the drive mode.

During the emission state 305 as shown in FIG. 10, the emission signal EM[i] 210 is set to VDD, i.e. EM[i]=VDD and the write signal WR[i] 208 and the reset signal RST[i] 206 are set to zero, i.e. WR[i]=0 and RST[i]=0. These signals turn on the transistor T4 and turn off the transistors T3 and T2. The drive transistor T1 drives the OLED device D1 with the pixel current $I_{pixel}$ corresponding to the voltage stored in the capacitor ($C_s$) 212 and the characteristics of the drive transistor T1. Therefore the luminance of the OLED device D1, determined by $I_{pixel}$, is dependent upon a programming of the capacitor ($C_s$) 212 and the characteristics of the drive transistor T1.

OLED Measurement Mode

Figure 4:
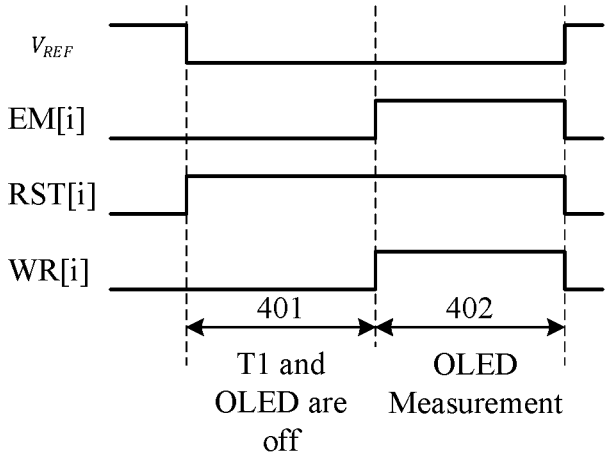
FIG. 4 is an example timing diagram of control signals of the pixel circuit in an OLED measurement mode.

In this mode, in order to determine the I-V characteristic of the OLED device which is utilized to compensate aging of the OLED, the OLED current is measured. A timing diagram for the control signals of the pixel circuit 200 in the OLED measurement mode is shown in FIG. 4. The timing diagram shown in FIG. 4 comprises an off state 401 and an OLED measurement state 402.

Figure 11:
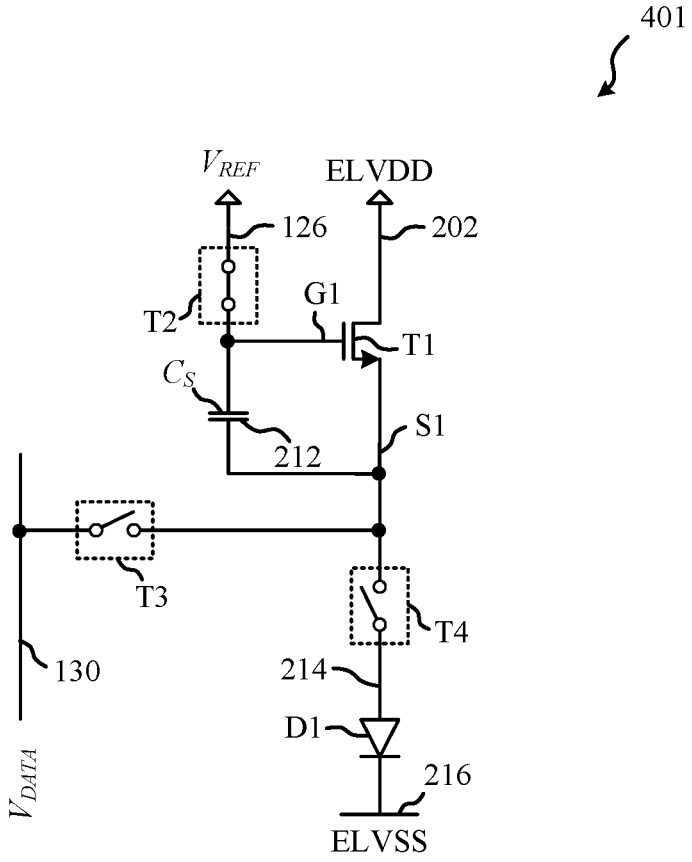
FIG. 11 is a schematic block diagram of the pixel circuit in an off state of the OLED measurement mode.

During the off state 401 as shown in FIG. 11, the emission signal EM[i] 210 and the write signal WR[i] 208 are set to zero, i.e. EM[i]=0 and WR[i]=0. This turns off transistors T3 and T4 causing node S1 to disconnect from $V_{DATA}$ and node 214, the anode of the OLED device D1, to disconnect from the rest of the pixel circuit. In this state, the reference voltage $V_{REF}$ on the reference line 126 is switched to the lowest voltage, for example zero, i.e. $V_{REF}$=0, while the reset signal RST[i] 206 is set to VDD, i.e. RST[i]=VDD, turning on transistor T2. This causes node G1 to connect to the reference line 126 having a voltage $V_{REF}$ set to 0, setting the gate-source voltage $V_{gs}$ of the drive transistor T1 to zero or a negative voltage, thereby turning off the drive transistor T1.

Figure 12:
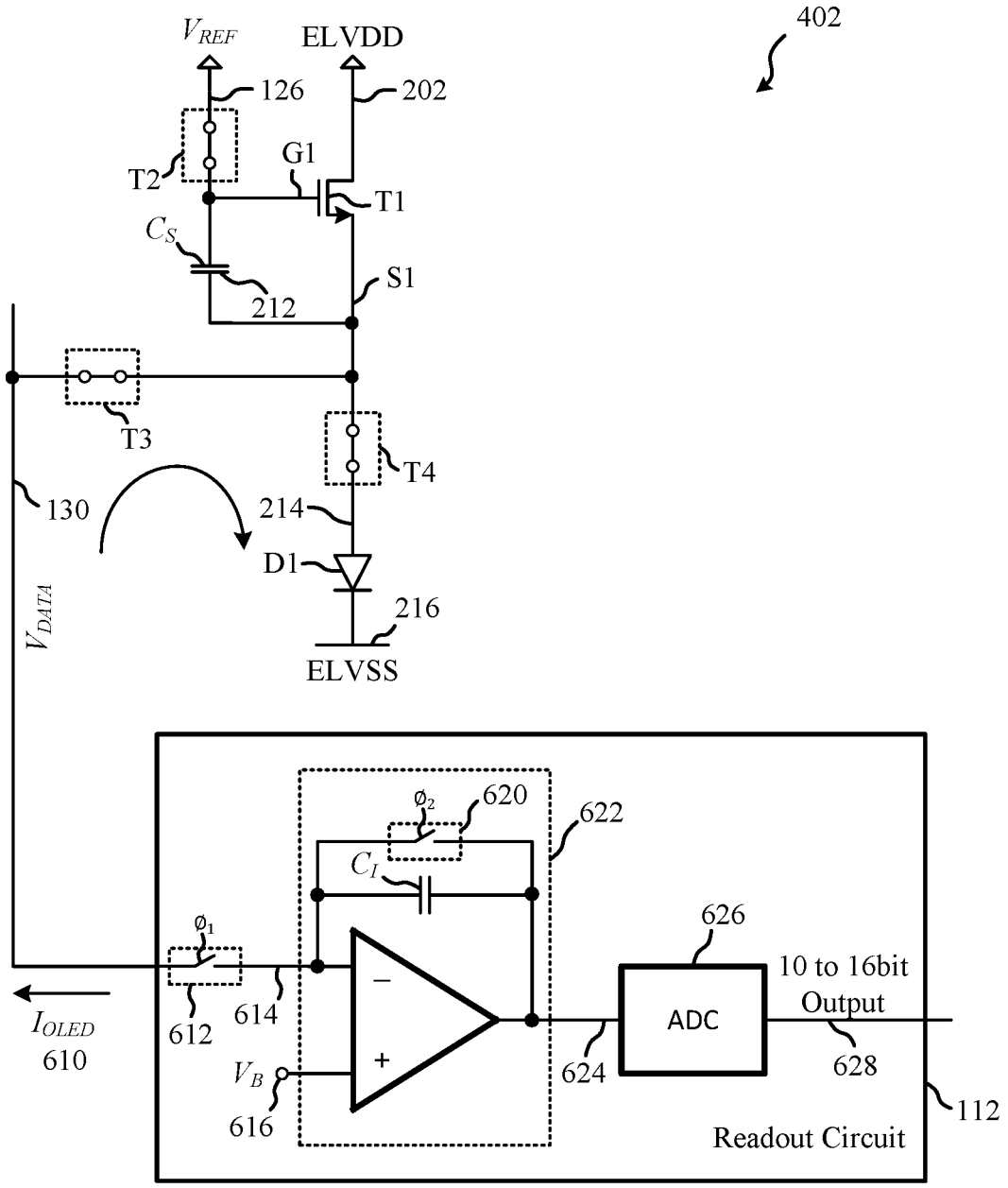
FIG. 12 is a schematic block diagram of the pixel circuit in an OLED measurement state of the OLED measurement mode.

During the OLED measurement state 402 as shown in FIG. 12, the emission signal EM[i] 210, the write signal WR[i] 208, and the reset signal RST[i] 206 are set to VDD, i.e. EM[i]=VDD, WR[i]=VDD, and RST[i]=VDD, turning on transistors T2, T3, and T4. In this state, the reference voltage $V_{REF}$ on the reference line 126 is held at the lowest voltage, for example zero, i.e. $V_{REF}$=0, while transistor T2 is on. This causes node G1 to stay connected to the reference line 126 having a voltage $V_{REF}$ set to 0, setting the gate-source voltage $V_{gs}$ of the drive transistor T1 to zero or a negative voltage, thereby keeping the drive transistor T1 completely off. In this state, the node S1 and the node 214, the anode of the OLED device D1, are connected to the data line 130 which is set to a voltage $V_{DATA}$ which is sufficient ($V_{DATA}>V_{OLED}$) to turn on the OLED device D1 and cause a current $I_{Oled}$ 610 to flow therethrough. In this state 402, the data line 130 is connected to the Readout Circuit (ROC) 112 to measure the OLED current $I_{Oled}$ 610. The OLED current $I_{Oled}$ 610 is measured and is converted to a corresponding voltage 624 which is quantized to 10 to 16 bit digital code 628 by an Analog-To-Digital Converter (ADC) 626.

In some embodiments, in order to characterize the I-V characteristic of the OLED device D1, the OLED measurement is conducted more than once, utilizing different data voltages $V_{DATA}$ each sufficient to turn on the drive transistor T1 as a switch and great enough ($V_{DATA}>V_{OLED}$) to turn on the OLED device D1, with whatever voltage spacing is desired to create an I-V characteristic curve of a desired resolution.

Pixel Measurement Mode

Figure 5:
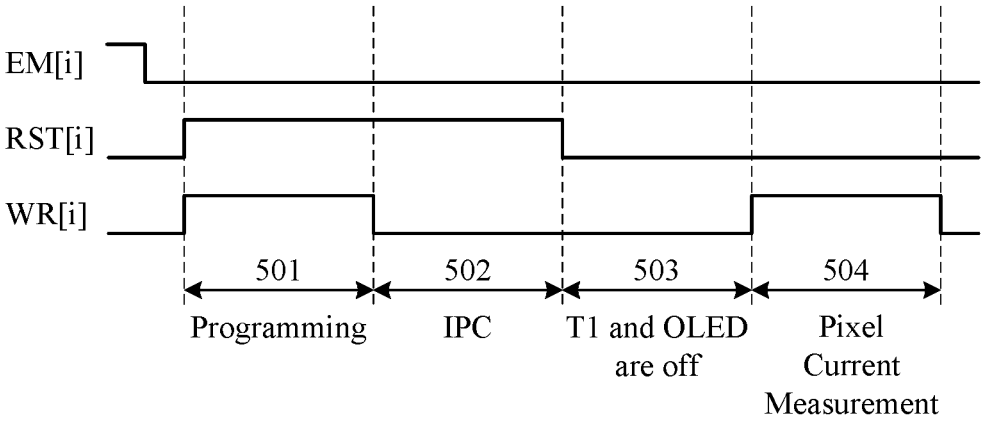
FIG. 5 is an example timing diagram of control signals of the pixel circuit in a pixel measurement mode.

The pixel current is measured in the pixel measurement mode. A timing diagram for the control signals of the pixel circuit 200 in the pixel measurement mode is shown in FIG. 5. The timing diagram shown in FIG. 5 comprises four states which include, a programming state 501, an IPC state 502, an off state 503 during which the TFTs and OLED are turned off, and a pixel current measurement state 504.

Figure 13:
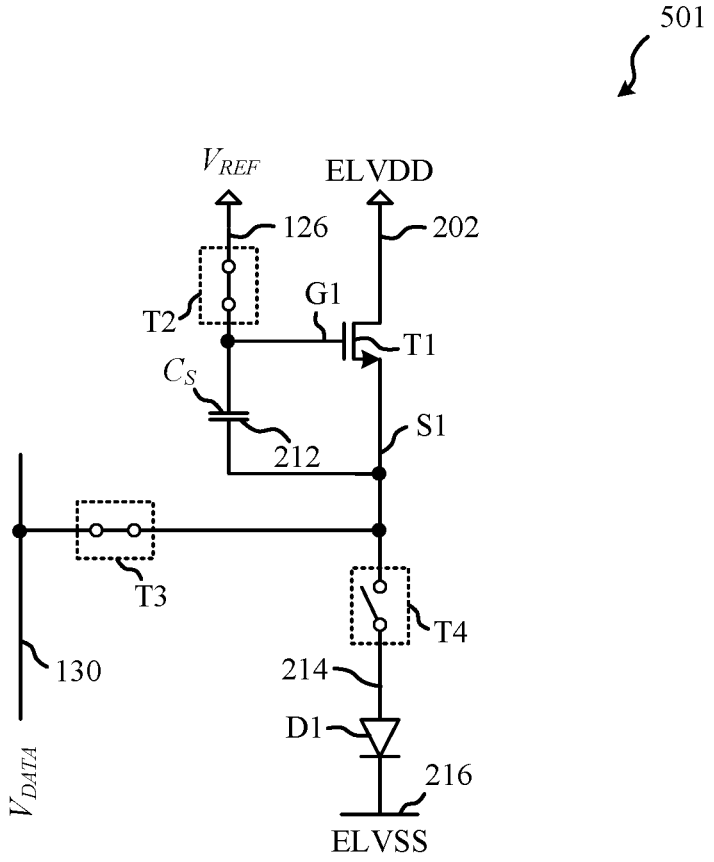
FIG. 13 is a schematic block diagram of the pixel circuit in a programming state of the pixel measurement mode.

During the programming state 501 as shown in FIG. 13, the emission signal EM[i]210 is set to zero, i.e. EM[i]=0, turning off transistor T4. The write signal WR[i] 208 and the reset signal RST[i] 206 are set to VDD, i.e. WR[i]=VDD and RST[i]=VDD. These signals turn on the transistors T3 and T2 and connect the node G1 to $V_{REF}$ and the node S1 to $V_{DATA}$. The storage capacitor $C_s$ 212 is charged to $V_{REF}-V_{DATA}$ which is the difference between the voltage on the data line 130 and the voltage on the reference line 126. At the end of this state, the voltage stored in the storage capacitor $C_s$ 212 is equal to:

$$V_{C_s}=V_{REF}-V_{DATA}. \tag{3}$$

Figure 14:
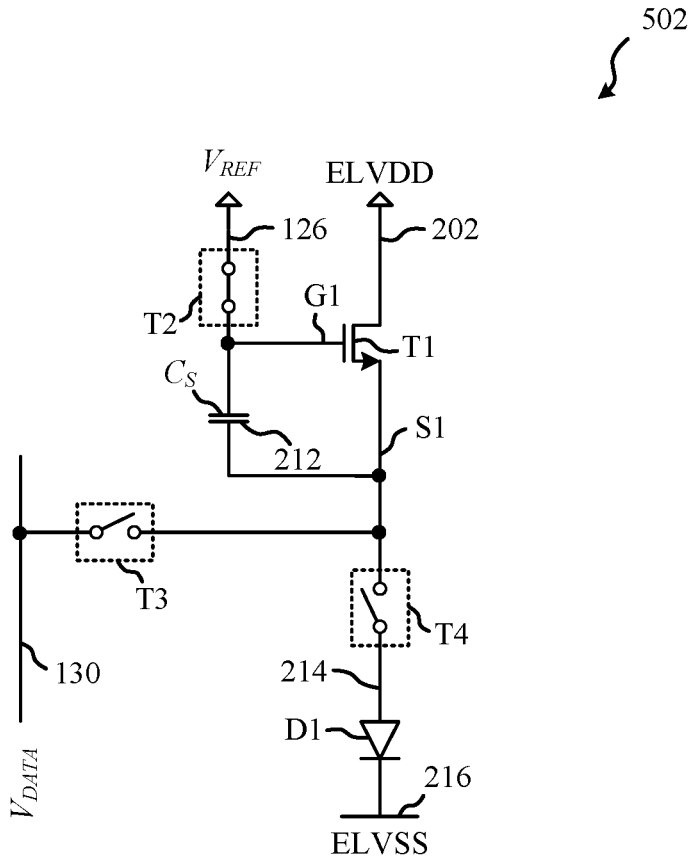
FIG. 14 is a schematic block diagram of the pixel circuit in an IPC state of the pixel measurement mode.

During the In-Pixel Compensation (IPC) state 502 as shown in FIG. 14, the emission signal EM[i] 210 and the write signal WR[i] 208 are set to zero, i.e. EM[i]=0 and WR[i]=0. These signals turn off the transistors T4 and T3. The node S1 is disconnected from the data line 130. The reset signal RST[i] signal 206 is set to VDD, i.e. RST[i]=VDD. This turns on the transistor T2. The drive transistor T1 is turned on and IPC is performed in this state. At the end of this state, the voltage stored in the storage capacitor $C_s$ 212 is equal to:

$$V_{C_s}=V_{REF}-V_{DATA}-\Delta V_{IPC} \tag{4}$$

where $\Delta V_{IPC}$ is the voltage drop during this state.

Figure 15:
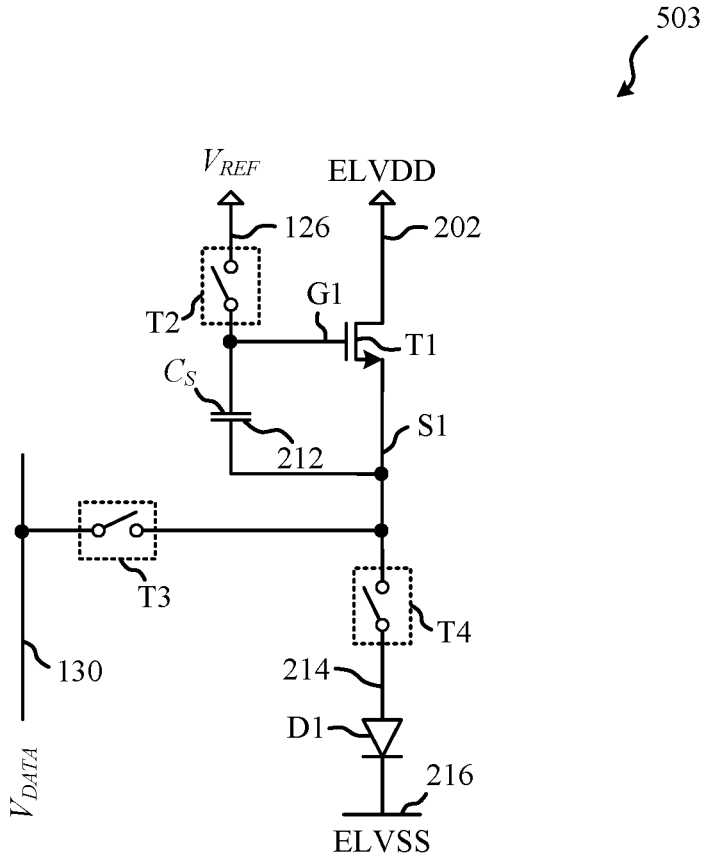
FIG. 15 is a schematic block diagram of the pixel circuit in an off state of the pixel measurement mode.

During the off state 503 as shown in FIG. 15, the emission signal EM[i] 210, the write signal WR[i] 208 and the reset signal RST[i] 206 are set to zero, i.e. EM[i]=0, WR[i]=0 and RST[i]=0. These signals turn off the transistors T4, T3 and T2 and disconnect the node S1 from the data line 130 and the node G1 from the reference line 126. During the off state 503, no current is passing through the OLED device D1 and it is off during this state.

Figure 16:
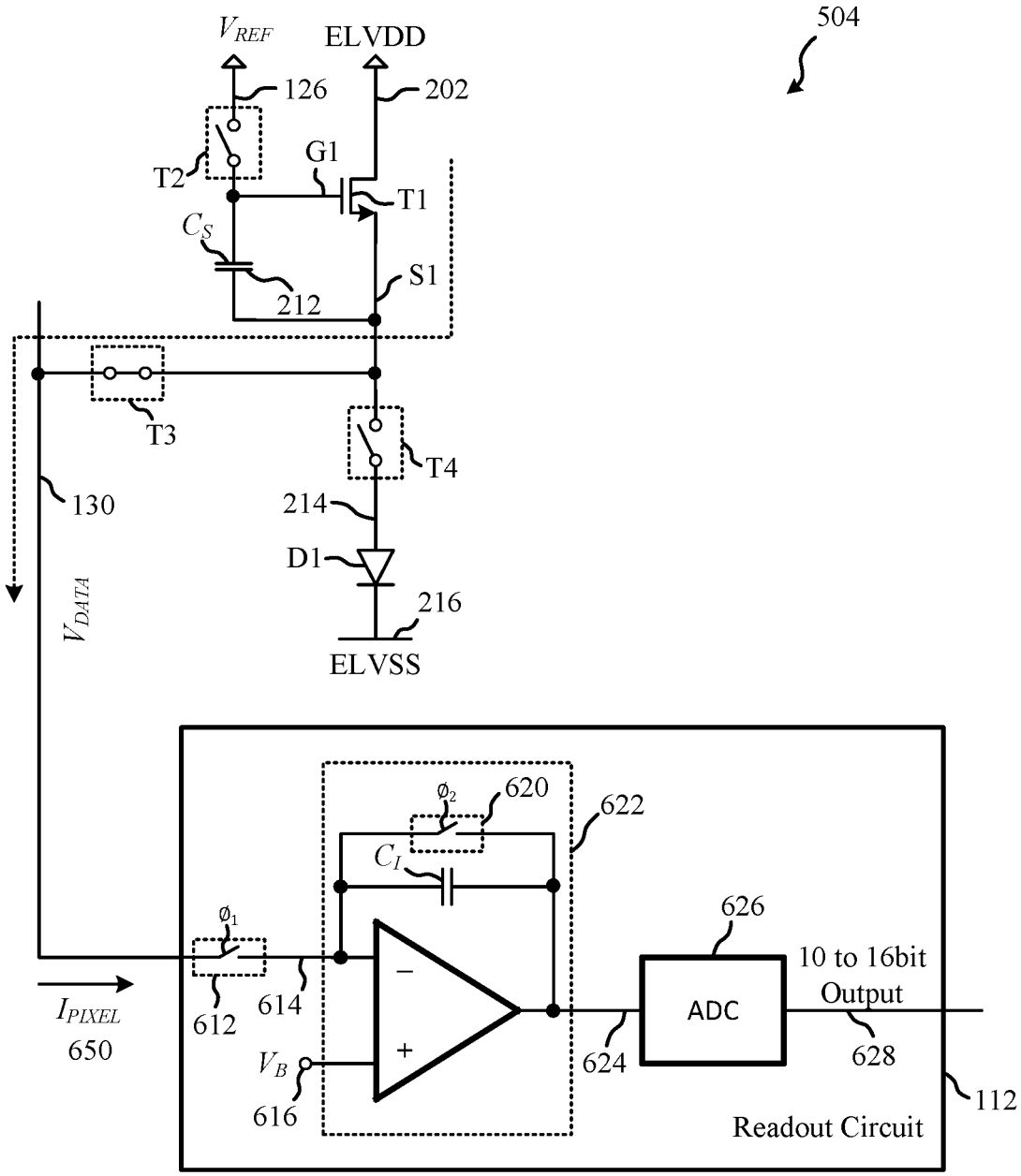
FIG. 16 is a schematic block diagram of the pixel circuit in a pixel current measurement state of the pixel measurement mode.

During the pixel current measurement state 504 as shown in FIG. 16, the emission signal EM[i] 210 and the reset signal RST[i] 206 are set to zero, i.e. EM[i]=0 and RST[i]=0. The write signal WR[i] 208 is set to VDD, i.e. WR[i]=VDD. The write signal WR[i] 208 turns on the transistor T3 and the node S1 is connected to the data line 130. In this state, the data line 130 is connected to the ROC 112 to measure the pixel current $I_{Pixel}$ 650. The drive transistor T1 drives the OLED device D1 with the pixel current $I_{Pixel}$ corresponding to the voltage stored in the capacitor ($C_s$) 212 and the characteristics of the drive transistor T1. The pixel current $I_{Pixel}$ 650 is measured in this state and this current is converted to a corresponding voltage 624 which is quantized to 10 to 16 bit digital code 628 by the ADC 628.

In some embodiments, in order to characterize the drive transistor T1, pixel measurement is performed more than once, utilizing different voltages to program the capacitor ($C_s$) 212. In some embodiments, two points of an I-V curve for the drive transistor T1 are extracted using two different programming voltages for the capacitor and measuring the resulting two different pixel currents $I_{Pixel}$, and the rest of the I-V curve is extrapolated with use of those two points.

The ROC 112 as shown in FIG. 12 and FIG. 16 includes an integrator 622, an analog to digital converter (ADC) 626, and one switch 612 coupling the ROC 112 to the data line 130 at the integrator 622. The integrator 622 includes a reset switch 620 and an integrating capacitor $C_I$ in parallel and connected between a first input 614 and an output of the integrator 624 and a bias voltage $V_B$ coupled to a second input 616 of the integrator 624. During measurement, the switch 612 is closed and the integrator 622 integrates the current coming from pixel 200 ($I_{Pixel}$ 650 or $I_{oled}$ 610) and converts it to a corresponding voltage 624. The output voltage of the integrator 624 is applied to the ADC 626 and this voltage is converted to 10 to 16 bit digital code 628 by the ADC 626.

Although the embodiments have been described with functionality of the transistors resulting from the application of particular example voltage values such as "VDD" or "0" or "VSS", it is to be understood that in different contexts, the application of "high" and "low" voltages of appropriate different voltage values may be used to effect the same functionality from transistors and do not represent a departure from the embodiments disclosed above.

While particular implementations and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of an invention as defined in the appended claims.

What is claimed is:

1. A display system including an array of pixel circuits arranged in rows and columns, each including a drive transistor, a storage capacitor, and a light emitting device, the display system comprising:

a controller for driving each pixel circuit in a plurality of operation states for the pixel circuit including a programming state for programming the storage capacitor of the pixel circuit with use of a data voltage provided over a data line of the display system, and at least two measurement states for measuring current from the pixel circuit over the data line; and a pixel circuit of the array of pixel circuits including:

a drive transistor including a first terminal coupleable to the data line;

a storage capacitor coupled across a gate terminal and the first terminal of the drive transistor;

a light emitting device coupleable to the first terminal of the drive transistor; and a first transistor coupled to the first terminal of the drive transistor and coupled between the drive transistor and the light emitting device, for coupling the light emitting device to the first terminal of the drive transistor during a first measurement state of the at least two measurement states and for decoupling the first terminal of the drive transistor from the light emitting device during a second measurement state of the at least two measurement states.

2. The display system of claim 1, further comprising a readout circuit coupleable to the data line for measuring the current from the pixel circuit over the data line.

3. The display system of claim 2 wherein the readout circuit comprises an integrator for integrating said current from the pixel during said measuring and generating an output voltage corresponding to said integrated current, and an analog to digital converter for converting said output voltage into a digital code output.

4. The display system of claim 2, wherein the readout circuit is not coupleable to the pixel circuit via a signal line different from the data line for measuring the current from the pixel circuit.

5. The display system of claim 1, wherein the first measurement state for measuring a current from the pixel circuit comprises an organic light emitting diode (OLED) measurement state for measuring an OLED current from the pixel circuit passing through said light emitting device.

6. The display system of claim 5, wherein the pixel circuit further comprises a reference line coupleable to a gate terminal of the drive transistor, and wherein the controller, during the OLED measurement state, couples the gate terminal of the drive transistor to the reference line and provides a reference voltage over the reference line sufficient to completely turn off the drive transistor, couples the light emitting device to the data line and provides a data voltage over the data line sufficient to turn on the light emitting device.

7. The display system of claim 6 further comprising a readout circuit coupleable to the data line for measuring the current from the pixel circuit over the data line, the readout circuit comprising an integrator for integrating said OLED current from the pixel during said measuring and generating a corresponding output voltage, and an analog to digital converter for converting said output voltage into a digital code output, wherein the controller couples the gate terminal of the drive transistor to the reference line with use of a second transistor in the pixel circuit, and couples the light emitting device to the data line with use of a third transistor coupled between the first terminal of the drive transistor and the data line.

8. The display system of claim 1, wherein the second measurement state for measuring a current from the pixel circuit comprises a pixel circuit measurement state for measuring a pixel circuit current from the pixel circuit passing through said drive transistor, said pixel circuit measurement state subsequent to the programming state.

9. The display system of claim 8, wherein the controller, during the pixel circuit measurement state, decouples the light emitting device from the first terminal of the drive transistor with use of the first transistor and couples the first terminal of the drive transistor to the data line.

10. The display system of claim 9 further comprising a readout circuit coupleable to the data line for measuring the current from the pixel circuit over the data line, the readout circuit comprising an integrator for integrating said pixel circuit current from the pixel circuit during said measuring and generating a corresponding output voltage and an analog to digital converter for converting said output voltage into a digital code output, wherein the pixel circuit further comprises a reference line coupleable to a gate terminal of the drive transistor, wherein the controller decouples the reference line from the gate terminal of the drive transistor to maintain a voltage difference across the storage capacitor, and wherein the controller couples the first terminal of the drive transistor to the data line with use of a third transistor coupled between the first terminal of the drive transistor and the data line.

11. The display system of claim 1, wherein the pixel circuit comprises transistors which are only n-type thin film transistors (TFTs), and wherein said light emitting device is an OLED.

12. The method of claim 11, further comprising turning on the first transistor during the first measurement state, wherein measuring the current from the pixel circuit comprises measuring an OLED current from the pixel circuit passing through said light emitting device during an OLED measurement state.

13. The method of claim 12, wherein the pixel circuit further comprises a reference line coupleable to a gate terminal of the drive transistor, and wherein measuring the OLED current during the OLED measurement state comprises, coupling the gate terminal of the drive transistor to the reference line, providing a reference voltage over the reference line sufficient to completely turn off the drive transistor, coupling the light emitting device to the data line, and providing a data voltage over the data line sufficient to turn on the light emitting device.

14. The method of claim 13 wherein measuring the OLED current during the OLED measurement state comprises:

coupling the gate terminal of the drive transistor to the reference line with use of a second transistor in the pixel circuit;

coupling the light emitting device to the data line with use of a third transistor coupled between the first terminal of the drive transistor and the data line; and coupling a readout circuit to the data line and measuring said current from the pixel circuit with use of said readout circuit, including, integrating said OLED current from the pixel circuit, generating an output voltage corresponding to the integrated current, and converting said output voltage into a digital code output.

15. A method of driving a display system, the display system including an array of pixel circuits arranged in rows and columns, a pixel circuit of the array of pixel circuits including: a drive transistor including a first terminal coupleable to a data line of the display system; a storage capacitor coupled across a gate terminal and the first terminal of the drive transistor; a light emitting device coupleable to the first terminal of the drive transistor; and a first transistor coupled to the first terminal of the drive transistor and coupled between the drive transistor and the light emitting device, the method comprising:

driving the pixel circuit in a plurality of operation states for the pixel circuit including:

programming the storage capacitor of the pixel circuit with use of a data voltage provided over the data line and turning off the first transistor during a programming state, and measuring a current from the pixel circuit over the data line during at least two measurement states, including controlling the first transistor for coupling the light emitting device to the first terminal of the drive transistor during a first measurement state of the at least two measurement states and controlling the first transistor for decoupling the first terminal of the drive transistor from the light emitting device during a second measurement state of the at least two measurement states.

16. The method of claim 15, wherein measuring the current from the pixel circuit comprises coupling a readout circuit to the data line and measuring said current from the pixel circuit with use of said readout circuit.

17. The method of claim 16 wherein measuring said current from the pixel circuit with use of said readout circuit comprises integrating said current from the pixel circuit, generating a corresponding output voltage, and converting said output voltage into a digital code output.

18. The method of claim 16, wherein the readout circuit is not coupleable to the pixel circuit via a signal line different from the data line for measuring the current from the pixel circuit.

19. The method of claim 15, further comprising turning off the first transistor during the second measurement state, wherein measuring said current from the pixel circuit comprises measuring a pixel circuit current from the pixel circuit passing through said drive transistor, during a pixel circuit measurement state subsequent to the programming state.

20. The method of claim 19, wherein measuring the pixel current during the pixel circuit measurement state comprises decoupling the light emitting device from the first terminal of the drive transistor with use of the first and coupling the first terminal of the drive transistor to the data line.

21. The method of claim 20 wherein measuring the pixel circuit current during the pixel circuit measurement state comprises:

decoupling a reference line from the gate terminal of the drive transistor to maintain a voltage difference across the storage capacitor;

coupling the first terminal of the drive transistor to the data line with use of a third transistor coupled between the first terminal of the drive transistor and the data line; and coupling a readout circuit to the data line and measuring said current from the pixel circuit with use of said readout circuit, including, integrating said pixel circuit current from the pixel circuit, generating an output voltage corresponding to the integrated current, and converting said output voltage into a digital code output.

22. The method of claim 15, wherein the pixel circuit comprises transistors which are only n-type TFTs, and wherein said light emitting device is an OLED.

* * * * *